US009596909B2

(12) United States Patent
Miyazaki et al.

(10) Patent No.: US 9,596,909 B2
(45) Date of Patent: Mar. 21, 2017

(54) SLIDE FASTENER

(75) Inventors: Yuichi Miyazaki, Toyama (JP); Shigeto Takahashi, Toyama (JP)

(73) Assignee: YKK Corporation (JP)

( * ) Notice: Subject to any disclaimer, the term of this patent is extended or adjusted under 35 U.S.C. 154(b) by 279 days.

(21) Appl. No.: 14/352,315

(22) PCT Filed: Oct. 19, 2011

(86) PCT No.: PCT/JP2011/074056

§ 371 (c)(1),
(2), (4) Date: Apr. 16, 2014

(87) PCT Pub. No.: WO2013/057807

PCT Pub. Date: Apr. 25, 2013

(65) Prior Publication Data

US 2014/0245574 A1 Sep. 4, 2014

(51) Int. Cl.

| | |
|---|---|
| ***A44B 19/34*** | (2006.01) |
| ***A44B 19/24*** | (2006.01) |
| ***A44B 19/26*** | (2006.01) |
| ***A44B 19/40*** | (2006.01) |
| ***D03D 1/00*** | (2006.01) |

(52) U.S. Cl.

CPC ..... *A44B 19/346* (2013.01); *A44B 19/24* (2013.01); *A44B 19/265* (2013.01); *A44B 19/403* (2013.01); *D03D 1/00* (2013.01); *D10B 2501/0631* (2013.01); *Y10T 24/2591* (2015.01); *Y10T 24/2596* (2015.01)

(58) Field of Classification Search

CPC ... A44B 19/346; A44B 19/265; A44B 19/403; A44B 19/24; A44B 19/26; A44B 19/34; D03D 1/00; D10B 2501/0631

USPC ..... 139/384 B

See application file for complete search history.

(56) References Cited

U.S. PATENT DOCUMENTS

| | | | | |
|---|---|---|---|---|
| 2,567,160 A | | 9/1951 | Wahl | |
| 2,940,478 A | * | 6/1960 | Hendley | A44B 19/346 139/384 B |

(Continued)

FOREIGN PATENT DOCUMENTS

| | | |
|---|---|---|
| FR | 1 020 397 A | 2/1953 |
| GB | 2054678 A | 2/1981 |

(Continued)

OTHER PUBLICATIONS

International Search Report, PCT Application No. PCT/JP2011/074056 mailed Jan. 17, 2012.

(Continued)

*Primary Examiner* — Abigail Morrell

(74) *Attorney, Agent, or Firm* — Kilpatrick Townsend & Stockton LLP

(57) ABSTRACT

In a slide fastener, a fastener tape is woven with a single-woven structure, and in the fastener tape, a double-woven region woven with a double-woven structure is formed along a tape longitudinal direction. An inner single-woven region and an outer single-woven region of the single-woven structure are formed at a tape inner edge side and a tape outer edge side of the double-woven region. Thus, even if the fastener tape makes contact with ridge line portions on a lower blade side of the slider when the slider is slid, weft yarns arranged in the double-woven region are less likely to be cut.

6 Claims, 8 Drawing Sheets

(56) References Cited

U.S. PATENT DOCUMENTS

| | | | |
|---|---|---|---|
| 3,885,276 | A | 5/1975 | Moertel |
| 4,354,532 | A | 10/1982 | Tsubata |
| 4,718,149 | A | 1/1988 | Tsubokawa |
| 4,924,560 | A | 5/1990 | Matsuda et al. |
| 5,042,117 | A | 8/1991 | Tsubata |
| 5,329,674 | A | 7/1994 | Tomita et al. |

FOREIGN PATENT DOCUMENTS

| | | | |
|---|---|---|---|
| JP | 47-187 | Y1 | 1/1972 |
| JP | 49-9447 | Y1 | 3/1974 |
| JP | 22003/1981 | | 2/1981 |
| JP | 56-43723 | | 10/1981 |
| JP | 155313/1985 | | 10/1985 |
| JP | 63-294804 | A | 12/1988 |
| JP | 3-15402 | A | 1/1991 |
| JP | 5-305001 | A | 11/1993 |
| JP | 2006-015069 | A | 1/2006 |
| WO | 2011/027458 | A1 | 3/2011 |

OTHER PUBLICATIONS

Supplementary Search Report, European Patent Application No. 11874328.5, mailed Apr. 13, 2015.

* cited by examiner

SLIDE FASTENER

This application is a national stage application of PCT/JP2011/074056, which is incorporated herein by reference.

TECHNICAL FIELD

The invention relates to a slide fastener and a concealed type slide fastener, in particular, relates to the slide fastener and the concealed type slide fastener configured in such a way that weft yarns of a woven fastener tape are less likely to be cut depending on a slider even if a slider is repeatedly slid.

BACKGROUND ART

Conventionally, in order to open and close an opening portion of bags and the like smoothly, the slide fastener is attached to the opening portion, and the slide fastener is opened and closed by sliding the slider along an element row in the direction of disengagement or in the direction of engagement of the element row.

In such a slide fastener, generally, in order to perform opening and closing operations smoothly, it is desired to improve slidability and operability of the slider and to prevent other members from being caught in a tape insertion gap of the slider when the slider is slid.

Further, in the slide fastener, a repeated sliding operation of the slider over a long period of time tends to cause a problem that a fastener tape is worn by a friction occurred between the slider and the fastener tape, and a problem that the slider destroys the fastener tape by making contact with the fastener tape and cutting a constituent yarn of the fastener tape, which is a factor of shortening of the life of the slide fastener.

In Japanese Examined Patent Publication No. 56-43723 (Patent Document 1), the slide fastener that a concave groove portion is formed on a tape side edge portion of the fastener tape in order to prevent wear of the fastener tape and a failure of the slide fastener caused by sliding of the slider is disclosed.

Specifically explained, the slide fastener 100 described in Patent Document 1, as shown in FIG. 13, has a pair of fastener stringers 101 that an element row 103 is attached to the tape side edge portion opposed to the woven right and left fastener tapes 102 and the slider 104 slidably arranged along the element row 103.

The fastener tape 102 has a tape edge portion 102*a* arranged at a tape side edge by increasing the thickness compared to a tape main body portion and a concave groove portion 102*b* formed on the tape front and back surfaces by pressing the fastener tape 102. The concave groove portion 102*b* is arranged to a position adjacent to the element row 103 along the tape longitudinal direction.

Further, upper and lower flange portions 104*a* and 104*b* of the slider 104 are arranged so as to correspond to each other on the concave groove portion 102*b* arranged at each of the right and left fastener tapes 102, and the slider 104 is slid in a state of inserting the upper and lower flange portions 104*a* and 104*b* into the concave groove portion 102*b* of the fastener tape 102.

With the slide fastener 100 described in Patent Document 1, when sliding the slider 104 to engage or disengage the right and left element rows 103, the slider 104 makes contact with the fastener tape 102, but it enables to reduce the pressure applied to the fastener tape 102 from the slider 104. Therefore, even if sliding of the slider 104 is repeated, it allows to extend the life of the slide fastener 100 because the wear of the fastener tape 102 is reduced.

Further, according to Patent Document 1, since the concave groove portion 102*b* of the fastener tape 102 is formed by pressing warp yarns and weft yarns that comprise the fastener tape 102, the concave groove portion 102*b* prevents an excessive slipping of warp yarns and weft yarns, and serves as a barrier to prevent breakage of the fastener tape 100 related to the slipping.

CITATION LIST

Patent Document

Patent Document 1: Japanese Examined Patent Publication No. 56-43723

SUMMARY OF THE INVENTION

Problems to be Solved by the Invention

In the case where a slide fastener is used by attaching to an opening portion of bags and the like, when sliding a slider in order to open and close the slide fastener, generally, the sliding operation of the slider is performed while pulling a pull tab of the slider. At this time, the slider is slid while being pulled obliquely upward by the pull tab.

Therefore, the lower flange portion arranged on a lower blade of the slider, in particular, a ridge line portion disposed between an upper end surface and an outer side surface at the lower flange portion, often moves along the tape longitudinal direction while making contact with the back surface of the fastener tape. Further, as stated in the above-mentioned Patent Document 1, even if the concave groove portion 102*b* corresponding to the lower flange portion 104*b* of the slider 104 is provided on the fastener tape 102, it was extremely difficult to prevent the lower flange portion 104*b* from contacting with the fastener tape 102.

Especially in this case, the contact of the lower flange portion with respect to the fastener tape tends to occur when the slider is slid in the direction of engagement of the element row in such a way that the slide fastener is closed and it is often the case that a shoulder-side end portion of the lower flange portion is in sliding contact with the tape surface of the fastener tape.

Incidentally, a fastener tape having a weave structure is generally formed with weft-inserting of weft yarns as reciprocating a carrier bar in an opening of warp yarns by using weft yarns composed of two-folded yarns and a plurality of warp yarns. In this case, warp yarns of the fastener tape are arranged along the direction parallel to the sliding direction of the slider, and weft yarns are arranged along the direction perpendicular to the sliding direction of the slider. These warp yarns and weft yarns are exposed on the both front and back surfaces of the fastener tape.

In the slide fastener configured using a fastener tape with such a weave structure, when the lower flange portion of the slider makes contact with the fastener tape as described above when the pull tab is pulled and the slider is slid, weft yarns arranged perpendicular to the sliding direction of the slider are damaged in the sliding direction of the slider by the lower flange portion of the slider and are easily impaired. Therefore, because the lower flange portion cuts weft yarns and destroys the fastener tape due to a repeated sliding of the slider, there was a problem that the slide fastener cannot endure a long-term usage.

In order to be less likely to occur cutting of weft yarns caused by such a contact with the lower flange portion, for example, by increasing the number of warp yarns arranged at a tape potion with which the lower flange portion of the fastener tape makes contact and increasing the density of warp yarns, it is considered that weft yarns are concealed by warp yarns at the tape portion.

In other words, warp yarns become more resistant to sliding of the slider than weft yarns because warp yarns are arranged parallel to the sliding direction of the slider. Thus, even if the lower flange potion makes contact with warp yarns when sliding the slider, warp yarns are less likely to be cut by the lower flange portion than weft yarns. Therefore, it is considered that cutting of weft yarns is less likely to occur by increasing the density of warp yarns at the tape portion with which the lower flange portion makes contact and by hiding weft yarns against the lower flange portion.

However, when increasing the density of warp yarns of the tape portion with which the lower flange portion actually makes contact and weaving the faster tape, warp yarns themselves are less likely to be cut even if sliding of the slider is repeated, but since warp yarns repeatedly receive a pressing force from the lower flange portion, a position of warp yarns is gradually shifted to the tape width direction, and the shift of yarns is occurred at the tape portion.

Once such a shift of warp yarns occurs, with moving of the lower flange portion along the tape longitudinal direction of the fastener tape, the shift of warp yarns is expanded so as to extend in the tape longitudinal direction, and weft yarns are completely exposed at the tape portion where the shift of yarns occurs. As a result, the exposed weft yarns are easily cut by the lower flange portion.

Especially in this case, no matter how the density of warp yarns is increased at the tape portion with which the lower flange portion makes contact, weft yarns are extended, so that it is difficult to prevent the shift of warp yarns caused by a contact of the slider and it cannot serve as a means to fundamentally resolve the problem of cutting of weft yarns.

The invention is made in view of the above conventional problems and a concrete object thereof is to provide a slide fastener and a concealed type slide fastener which enables to prevent a breakage of the fastener tape by making weft yarns of the woven fastener tape difficult to be cut even if a part of the slider makes contact with the fastener tape when sliding the slider and to stably use over a long period of time.

Means for Solving the Problems

To achieve the above object, a slide fastener provided by the invention includes, as a basic configuration, a pair of fastener stringers each having an element row attached along a respective tape inner side edge portion of a woven fastener tape, and a slider capable of engaging and disengaging the element rows. The slider has upper and lower blades, a guide post connecting between the upper and lower blades, lower flange portions erected along each of a right side edge portion and a left side edge portion of the lower blade and ridge line portions formed on each of the lower flange portions between an upper surface and an outer side surface of the lower flange portion. Each of the fastener tapes has an inner single woven region formed at the tape inner side edge portion and an outer single-woven region formed at a tape outer side edge portion of a double-woven region, the inner single-woven region and the outer single-woven region woven with a single-woven structure, the double-woven region woven with a double-woven structure and formed between the inner single-woven region and the outer single-woven region so the ridge line of the slider passes along the double-woven region. Each of the fastener tapes has weft yarns running in a tape width direction in the inner single-woven region, the double-woven region and the outer single-woven region. Each of the double-woven regions includes a first weave portion on a tape upper surface side and a second weave portion on a tape lower surface side, and the weft varen in the double-woven region are divided into the first weave protion and the second wave portion. The weft yarns are connected together at an end portion of the inner single-woven region on the side of the double-woven region and an end portion of the outer single-woven region on the side of the double-woven region.

In the slide fastener according to the invention, it is preferable that a lower flange portion is erected at right and left side edge portions of the lower blade in the slider and the ridge line portion be arranged between the upper end surface and the outer side surface at the lower flange portion.

In this case, it is particularly preferable that a boundary between the double-woven region and the inner single-woven region in the fastener tape is arranged between a position of an inner side surface and an outside position of the ridge line portion at the lower flange portion of the slider.

The slide fastener according to the invention can be configured so that the lower blade of the slider is formed flat and the ridge line portion is arranged between the upper surface and the outer side surface of the lower blade.

In such a slide fastener according to the invention, it is preferable that the double-woven structure is a hollow weave structure.

Also, it is preferable that a core thread is woven into the tape inner side edge portion of the fastener tape and a fastener element of the element row is attached to the tape inner side edge portion. The fastener element includes a pair of leg portions sandwiching the fastener tape or a body portion fixed to the fastener tape, and an end portion of the leg portions or the body portion is located on the inner single-woven region.

Further, it is preferable that eight or more but not exceeding 12 warp yarns are arranged at the region of double-woven structure.

Furthermore, in the slide fastener of the invention, it is preferable that the fastener tape has a core thread portion along a tape inner side edge. The core thread portion is composed by forming a double-woven structure on the side of further tape inner side edge of the inner single-woven region in the fastener tape and by holding and stabilizing a core thread within the double-woven structure.

Also, a concealed type slide fastener provided by the invention comprises a pair of concealed type fastener stringers having a folded tape portion folded into the U-shape between a tape main body portion and an element attaching portion of right and left woven fastener tapes in which a fastener element is attached to the element attaching portion in a state of projecting a coupling head of the fastener element outward from the folded tape portion, and a slider, which is capable of engaging and disengaging an element row of the fastener element. The slider has upper and lower blades, a guide post connecting between the upper and lower blades, and a lower flange portion erected in a standing upright state at the side edge portion of the lower blade. The lower flange portion has a ridge line portion between an opposed upper surface opposite to the upper blade and an outer side surface of the lower flange portion. The fastener tape is woven with a single-woven structure, and in the fastener tape, a double-woven region woven with a double-woven structure is formed along a tape longitudinal direction corresponding to a position of the ridge line portion of the slider. An inner single-woven region and an outer single-woven region of the single-woven structure are formed at a tape inner edge side and a tape outer edge side of the double-woven region in the fastener tape.

In the concealed type slide fastener according to the invention, it is preferable that the boundary between the double-woven region and the inner single-woven region of the fastener tape is arranged between a position of an inner side surface and an outside position of the ridge line portion at the lower flange portion of the slider.

Further, it is preferable that 8 or more but not exceeding 12 warp yarns are arranged at the double-woven region.

Effects of the Invention

In a normal-type of slide fastener according to the invention, the slider has the ridge line portion between the opposed upper surface opposite to the upper blade at the side edge portion on the side of the lower blade and the outer side surface of the lower blade. Further, the fastener tape is woven with a single-woven structure, and in the fastener tape, the double-woven region woven with a double-woven structure is formed along the tape longitudinal direction at a predetermined region of the tape width direction including the tape portion corresponding to a position of the ridge line portion of the slider.

In this case, the double-woven region has a first weave portion arranged on the side of a first surface (upper surface) of the tape and a second weave portion arranged on the side of a second surface (lower surface) of the tape. Also, in this fastener tape, an inner single-woven region and an outer single-woven region woven with the single-woven structure are formed adjacent to the inner edge side and the outer edge side of the tape on the double-woven region, so as to be sandwiched the double-woven region in the tape width direction.

In such a slide fastener of the invention, for example, when a pull tab is pulled and the slider is slid, the slider is slid while being pulled obliquely upward by the pull tab as described above. At this time, since a fastener element inserting through an element guide passage of the slider is also lifted upward together with the slider, the fastener tape is curved so as to be inclined downward in the tape width direction from the element attaching portion to which the fastener element is attached toward the tape outer side edge portion, and the double-woven region of the fastener tape makes contact with the ridge line portion on the side of the lower blade of the slider.

In this case, in the slide fastener of the invention, since weft yarns forming the fastener tape are arranged by alternately dividing into the first weave portion and the second weave portion in the double-woven region, the density of weft yarns arranged to the first and the second weave portions, respectively, is smaller than the inner single-woven region and the outer single-woven region and the proportion of warp yarns exposed to the outer surface side of the double-woven region (i.e., the upper surface side of the first weave portion and the lower surface side of the second weave portion) becomes large.

Therefore, at the tape portion of the double-woven region arranged corresponding to the position of the ridge line portion of the slider in the faster tape, the extent (or the area) of weft yarns exposed to the lower surface side of the second weave portion becomes smaller than a case of the single-woven structure and weft yarns are less likely to directly make contact with the slider. Also, at the tape portion, since many warp yarns exposed to the lower surface side of the second weave portion can receive a contact of the slider, it enables to reduce the stress of weft yarns received from the slider and to protect weft yarns more effectively.

Therefore, even if the second weave portion arranged at the double-woven region of the fastener tape makes contact with the ridge line portion on the side of the lower blade of the slider when sliding the slider, a contact between weft yarns of the second weave portion and the slider is reduced, and further even if weft yarns of the second weave portion makes contact with the slider, the extent of damage that the weft yarns receive can be minimized, which enables to prevent cutting of weft yarns caused by a contact of the slider.

In addition, in the invention, as described above, when the fastener tape is curved so as to be inclined downward from the element attaching portion toward the tape outer side edge portion, in the double-woven region of the fastener tape, the first weave portion arranged at the upper surface side of the tape is propped up and supports a curvature of the fastener tape. This allows to keep the second weave portion which is arranged at the lower surface side of the tape and which makes contact with the ridge line portion on the side of lower blade of the slider in a state of slightly loosening, and to give the second weave portion a degree of freedom capable of moving in the tape width direction.

When the fastener tape is curved as mentioned above, the second weave portion contacting with the ridge line portion of the slider has a degree of freedom in the tape width direction. Therefore even if the second weave portion receives a pressing force when contacting with the slider, it enables to disperse the pressing force throughout the second weave portion and then, it is possible to prevent a position of each warp yarn from being shifted in the tape width direction, and to prevent an occurrence of a positional shift of warp yarns at the second weave portion.

Therefore, in the slide fastener of the invention, even if the slider is repeatedly slid for long-term usage, it is possible to prevent weft yarns from being exposed for a long time due to a positional shift of warp yarns. Therefore, it enables to extend the life of the slide fastener by effectively preventing cutting of weft yarns caused by sliding of the slider over a long period of time.

In addition, in the slide fastener of the invention, since the double-woven region of the fastener tape is arranged corresponding to the position of the ridge line portion on the side of lower blade of the slider, it is stated in another way that the double-woven region is arranged to the position adjacent to the fastener element of the fastener tape, and are arranged corresponding to a tape insertion gap which is formed between upper and lower blades of the slider.

Meanwhile, a double-woven region of the fastener tape has high flexibility compared to the inner single-woven region and the outer single-woven region of the fastener tape because warp yarns and weft yarns are arranged by dividing into the first weave portion on the side of upper surface and the second weave portion on the side of lower surface.

Since such a double-woven region having superior flexibility are arranged adjacent to the fastener element as described above, it is possible to allow a small movement of each fastener element when engaging and disengaging the element row by sliding the slider. Further, when the element row passes through a substantially Y-shaped element guide passage formed in the slider, it allows to cause the fastener tape to be easily curved along the element guide passage. As a result, slidability and operability of the slider are significantly improved, and it is possible to carry out a sliding operation of the slider smoothly with a light force.

Further, since the double-woven region of the fastener tape has the first weave portion on the side of upper surface and the second weave portion on the side of lower surface, the tape thickness of the double-woven region is formed thicker than the inner single-woven region and the outer single-woven region of the fastener tape.

Since such a thick double-woven region in tape thickness is arranged corresponding to the tape insertion gap of the slider as described above, the double-woven region can fill a space part of the tape insertion gap more widely. Therefore, when making the slider slide, it is possible to effectively prevent other members such as fabric other than the slide fastener from being caught in the tape insertion gap of the slider and to carry out sliding operation of the slider more smoothly and stably.

In such a slide fastener of the invention, even in a case where the lower flange portion is erected at right and left edge portions of the lower blade in the slider, and the ridge line portion on the side of the lower blade contacted with the fastener tape is disposed between the upper end surface and the outer side surface at the lower flange portion, it is possible to effectively prevent cutting of weft yarns caused by a contact of the slider, and to carry out sliding operation of the slider more smoothly and stably by improving slidability and operability of the slider.

In this case, in the slide fastener of the invention, a boundary between the double-woven region and the inner single-woven region in the fastener tape is arranged between a position of the inner side surface and the outside position of the ridge line portion at the lower flange portion of the slider, and thereby the inner single-woven region of the fastener tape is arranged corresponding to a position of an inside ridge line portion arranged between the upper end surface and the inner side surface at the lower flange portion.

For example, in the slide fastener, when the slider is repeatedly slid over a long period of time, due to a repeated occurrence of collision between the lower flange portion of the slider and the fastener element, a phenomenon that the inside ridge line portion at the lower flange portion is deformed toward the upper blade so as to sharpen gradually toward the tape insertion gap, occurs. As the inside ridge line portion extends to a pointed shape, the fastener tape easily makes contact with the ridge line portion, and the fastener tape is easily cut when the ridge line portion makes contact with the fastener tape.

Accordingly, by arranging the boundary between the double-woven region and the inner single-woven region as described above, if the tape portion of the fastener tape corresponding to an inside ridge line portion at the lower flange portion is configured by the inner single-woven region, it is possible to make the thickness of the tape portion thinner than the double-woven region. Therefore, even if the inside ridge line portion at the lower flange portion is deformed to the pointed shape, it makes difficult for the fastener tape to contact with the inside ridge line portion, which enables to inhibit an occurrence of failure that the fastener tape is cut by touching the inside ridge line portion over a long period of time.

Further, in the slide fastener of the invention, even in a case where the lower blade of the slider is formed flat, and the ridge line portion on the side of the lower blade contacted with the fastener tape is arranged between the upper surface and the outer side surface at the lower blade, it is possible to effectively prevent cutting of weft yarns caused by a contact of the slider, and to carry out sliding operation of the slider more smoothly and stably by improving slidability and operability of the slider.

In the slide fastener of the invention, since the double-woven structure is the hollow weave structure, it is possible to reliably form the first weave portion on the side of upper surface of the tape and the second weave portion on the side of lower surface of the tape at the double-woven region, and then the second weave portion, which makes contact with the ridge line portion on the side of lower blade when sliding the slider, can easily have a degree of freedom in the tape width direction.

Also, in the slide fastener of the invention, a core thread is woven into the tape inner side edge portion of the fastener tape, and the fastener element consisting of the element row is attached to the tape inner side edge portion. In addition, the fastener element includes a pair of leg portions sandwiching the fastener tape or the body portion fixed to the fastener tape, and the end portion of the tape width direction at the leg portions or the body portion is located on the inner single-woven region. Accordingly, the fastener element is attached to the fastener tape firmly, thus enabling to ensure attachment strength (or fixing strength) of the fastener element.

In addition, eight or more but not exceeding 12 warp yarns are arranged at the double-woven region in the invention. Setting the number of warp yarns arranged at the double-woven region eight or more enables to stably locate the tape portion corresponding to the position of the ridge line portion of the slider in the fastener tape and to stably prevent cutting of weft yarns caused by a contact of the slider.

Further, setting the number of warp yarns arranged at the double-woven region not more than 12 prevents the double-woven region from becoming too wide. This enables to prevent the double-woven region from being loose because a big gap is formed between the first weave portion and the second weave portion of the double-woven region, and to stabilize a tape form of the fastener tape.

In addition, in the slide fastener of the invention, the fastener tape has a core thread portion along the tape inner side edge, and the core thread portion is composed by forming the double-woven structure on the side of further tape inner side edge of the inner single-woven region in the fastener tape and by holding and stabilizing the core thread within the double-woven structure. Therefore, since the core thread portion of the fastener tape is stably provided without a position shift, the fastener element is firmly attached to the tape inner side edge portion of the fastener tape.

Next, in a concealed type slide fastener according to the invention, a lower flange portion of a slider has a ridge line portion between an opposed upper surface opposite to an upper blade and an outer side surface of the lower flange portion. Further, a fastener tape is woven with a single-woven structure, and in the fastener tape, a double-woven region woven with a double-woven structure is formed along the tape longitudinal direction in the predetermined region of the tape width direction including a tape portion corresponding to a position of the ridge line portion at the lower flange portion of the slider.

Also, in this fastener tape, an inner single-woven region and an outer single-woven region woven with the single-woven structure are formed adjacent to the tape inner edge side and the tape outer edge side on the double-woven region, so as to be sandwiched the double-woven region in the tape width direction.

In such a concealed type slide fastener of the invention, in the same way as the above-mentioned normal-type of slide fastener, since the extent (or the area) of weft yarns exposed to the side of a tape second surface of a second weave portion at the double-woven region becomes smaller than the case of the single-woven structure, weft yarns of the second weave portion are less likely to directly make contact with the ridge line portion of the slider. Also, since many warp yarns exposed to the lower surface side of the second weave portion can receive a contact of the slider, it enables to reduce the stress of weft yarns received from the slider and to protect weft yarns more effectively.

Accordingly, even if the second weave portion arranged in the double-woven region of the fastener tape makes contact with the ridge line portion at the lower flange portion of the slider when sliding the slider, a contact between weft yarns of the second weave portion and the slider is reduced. In addition, even if weft yarns of the second weave portion make contact with the slider, the extent of damage that the weft yarns receive can be minimized. Therefore, it enable to prevent cutting of weft yarns caused by a contact of the slider.

Further, in the invention, in the double-woven region of the fastener tape, the double-woven region is bent to the side of a tape second surface, the first weave portion arranged at the side of a tape first surface is propped up and supports a curvature of the fastener tape. This allows to keep the second weave portion which is arranged at the side of the tape second surface in a state of slightly loosening, and to give the second weave portion a degree of freedom capable of moving in the tape width direction.

The second weave portion contacting with the ridge line portion at the lower flange portion of the slider has a degree of freedom in the tape width direction in this manner. Therefore, even if the second weave portion receives a pressing force when contacting with the slider, it enables to disperse the pressing force throughout the second weave portion and then, it is possible to prevent a position of each warp yarn from being shifted in the tape width direction, and to prevent an occurrence of a positional shift of warp yarns at the second weave portion.

Therefore, in the concealed type slide fastener of the invention, even if the slider is repeatedly slid for long-term usage, it is possible to prevent weft yarns from being exposed for a long time due to a positional shift of warp yarns. Therefore, it enables to extend the life of the concealed type slide fastener by effectively preventing cutting of weft yarns caused by sliding of the slider over a long period of time.

In such a concealed type slide fastener of the invention, a boundary between the double-woven region and the inner single-woven region is arranged between a position of the inner side surface and the outside position of the ridge line portion at the lower flange portion of the slider, and thereby the inner single-woven region of the fastener tape is arranged corresponding to a position of the inside ridge line portion arranged between the upper end surface and the inner side surface at the lower flange portion.

If the tape portion of the fastener tape corresponding to the inside ridge line portion at the lower flange portion is configured by the inner single-woven region in this manner, it is possible to make the thickness of the tape portion thinner than the double-woven region. Therefore, for example, even if the slider is repeatedly slid over a long period of time and the inside ridge line portion at the lower flange portion is deformed to the pointed shape, it makes difficult for the fastener tape to contact with the inside ridge line portion, which enables to inhibit an occurrence of failure that the fastener tape is cut by touching the inside ridge line portion over a long period of time.

In such a concealed type slide fastener of the invention, since the double-woven structure is the hollow weave structure, it is possible to reliably form the first weave portion on the side of upper surface of the tape and the second weave portion on the side of lower surface of the tape at the double-woven region, and then the second weave portion which makes contact with the ridge line portion on the side of lower blade when sliding the slider can easily have a degree of freedom in the tape width direction.

In addition, eight or more but not exceeding 12 warp yarns are arranged at the double-woven region in the invention. Setting the number of warp yarns arranged at the double-woven region eight or more enables to stably locate the tape portion corresponding to the position of the ridge line portion of the slider in the fastener tape and to stably prevent cutting of weft yarns caused by a contact of the slider.

Further, setting the number of warp yarns arranged at the double-woven region not more than 12 prevents the double-woven region from becoming too wide. This enables to prevent the double-woven region from being loose because a big gap is formed between the first weave portion and the second weave portion of the double-woven region, and to stabilize a tape form of the fastener tape.

MODES FOR CARRYING OUT THE INVENTION

Preferred embodiments of the invention will be described below in detail by citing examples and referring to drawings. However, the invention is not limited to the embodiments described below and various alterations can be made insofar as the configuration is substantially the same as that of the invention and similar operational effects are achieved.

For example, in each embodiment described below, material and modes of the fastener element composing of an element row are not particularly limited and can be changed arbitrarily. Also, the fastener element may be attached to a tape inner side edge portion of a fastener tape after the fastener tape is woven, and may be attached to the tape inner side edge portion of the fastener tape at the same time as the fastener tape is woven.

First Embodiment

Figure 1:
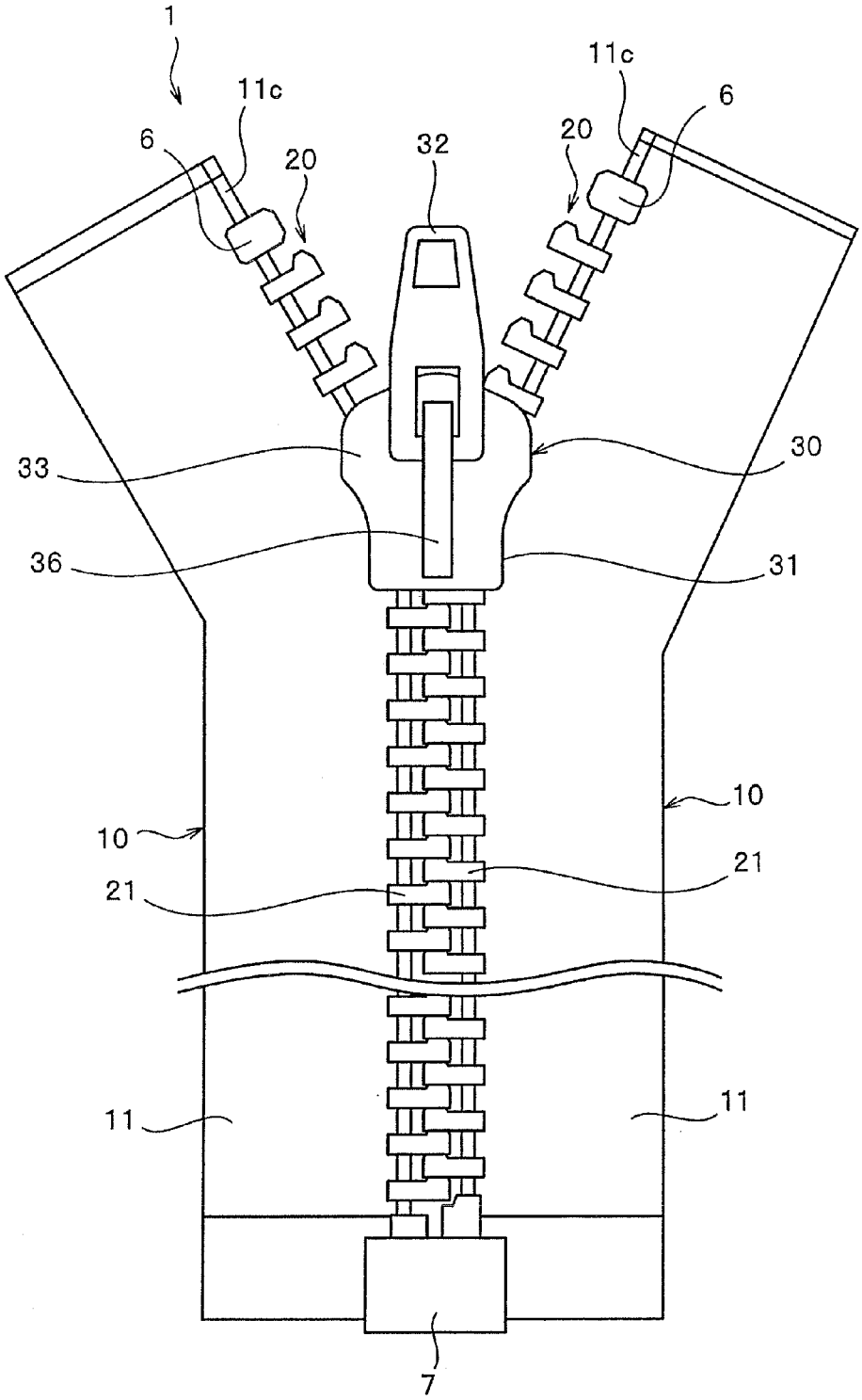
FIG. 1 is a schematic diagram showing a slide fastener according to a first embodiment of the invention.
Figure 2:
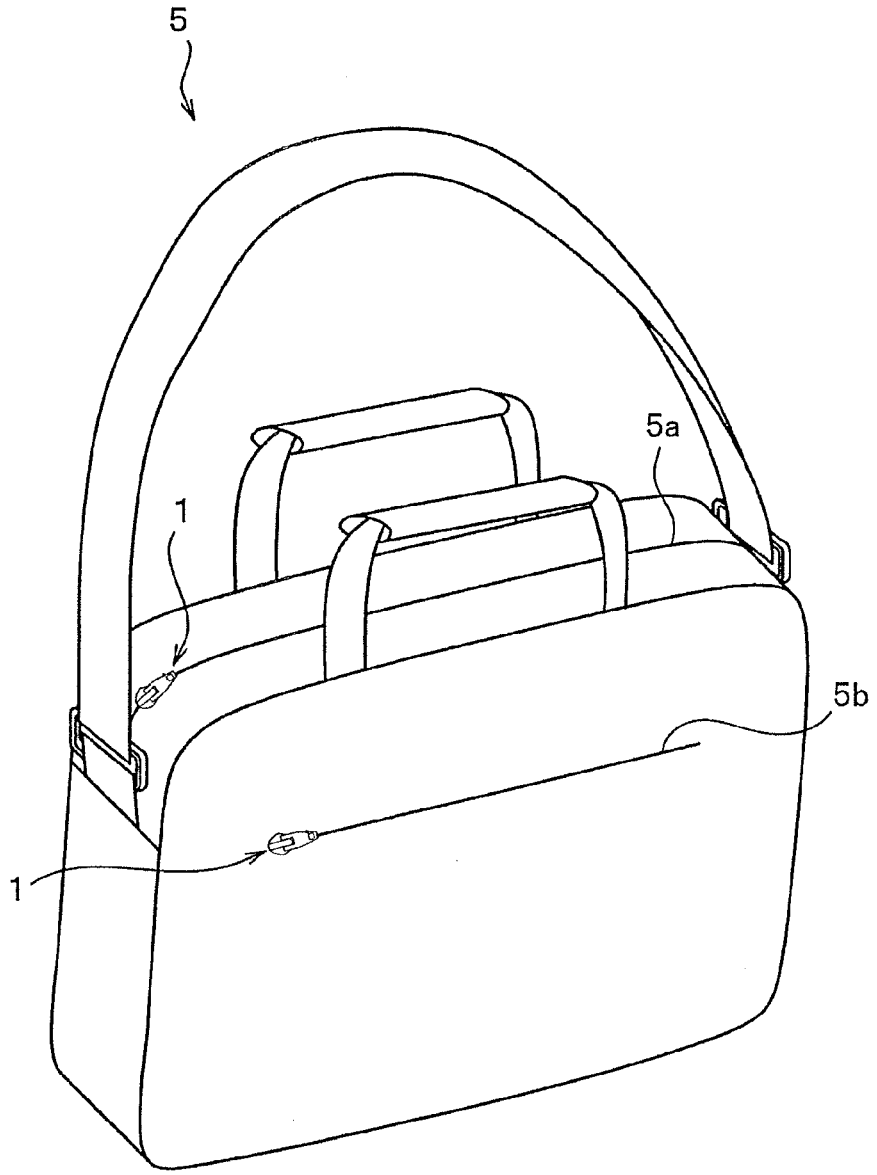
FIG. 2 is a perspective view showing a bag that the slide fastener is used.
Figure 3:
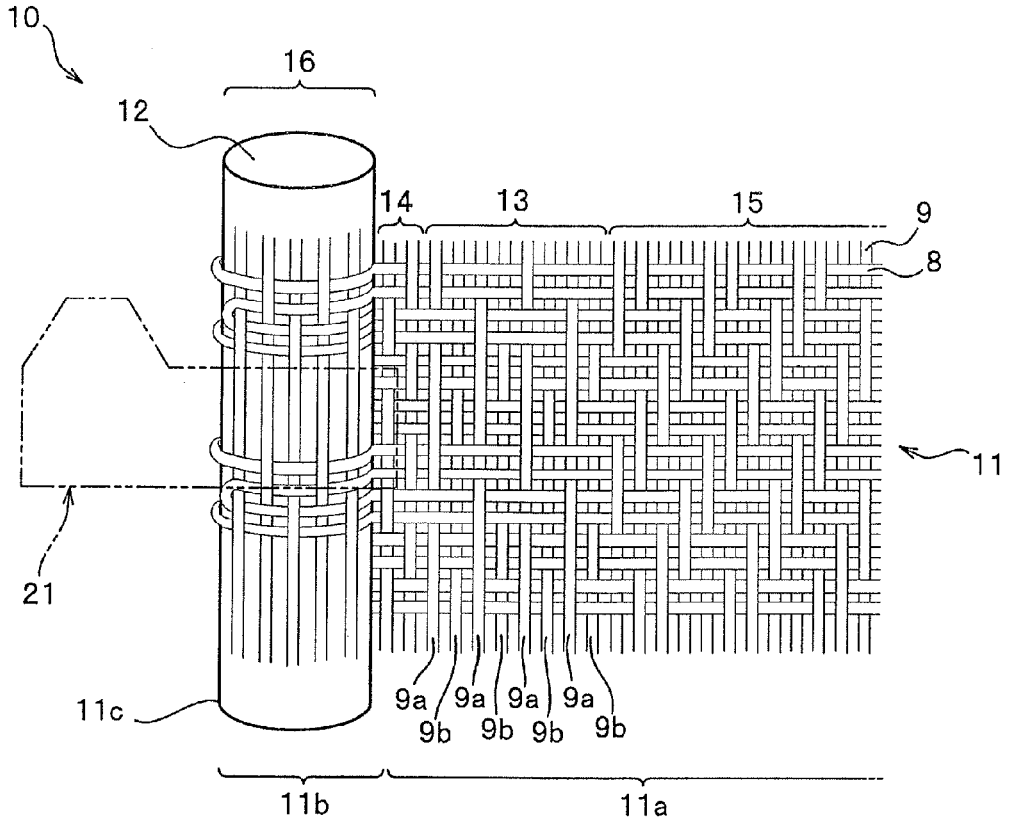
FIG. 3 is a structure diagram schematically showing a part of weave structure of a fastener tape in the slide fastener.
Figure 4:
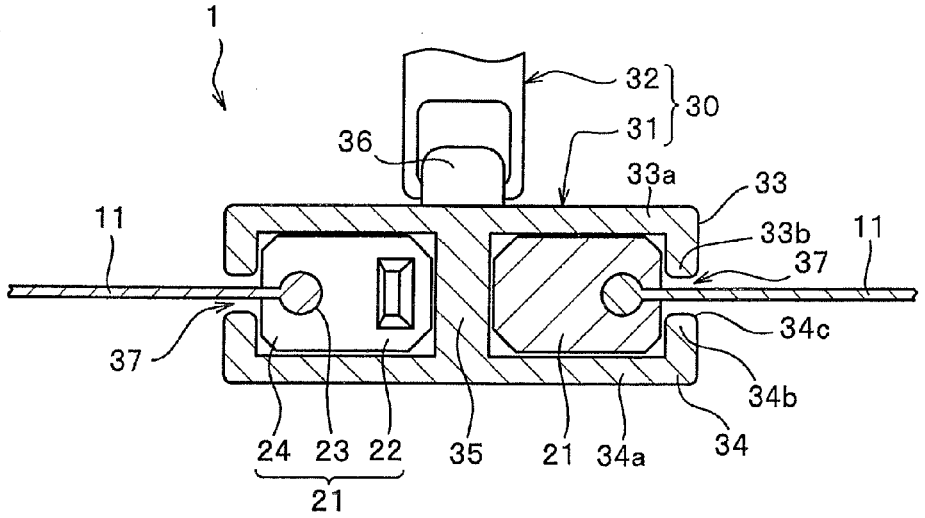
FIG. 4 is a cross sectional view of the slide fastener.

FIG. 1 is a schematic diagram showing a slide fastener according to the first embodiment of the invention and FIG. 2 is a perspective view showing a bag that the slide fastener is used. Also, FIG. 3 is a structure diagram schematically showing a part of weave structure of a fastener tape. Further, FIG. 4 is a cross sectional view of the slide fastener.

In the description described below, a forward and backward direction refers to a longitudinal direction of the fastener tape and is the same direction as a sliding direction of a slider. Particularly, a direction that the slider is slid in a way that the slide fastener is closed by engaging right and left fastener elements is defined as the forward, and a direction that the slider is slid in a way that the slide fastener is opened by disengaging right and left fastener elements is defined as the backward.

The right and left direction refers to a tape width direction of the fastener tape and a direction parallel to the tape surface of the fastener tape and perpendicular to the tape longitudinal direction. In addition, an upward and downward direction refers to a front and back direction of a fastener tape perpendicular to the tape surface of the fastener tape, and especially, a direction of the side on which a pull tab of the slider is arranged with respect to the fastener tape is defined as the upward and a direction of the opposite side thereof is defined as the downward.

A slide fastener 1 according to the first embodiment is configured as a normal-type of slide fastener that an element row 20 is formed on a tape inner side edge portion lib of a band-like fastener tape 11. The slide fastener 1 according to the first embodiment, for example, as shown in FIG. 2, is used by being attached to an opening portion 5*a* of a main storage part of a bag 5 (shoulder bag) and an opening portion 5*b* of an outside pocket.

The slide fastener 1 according to the first embodiment includes a pair of fastener stringers 10 on which the element row 20 is formed by a plurality of fastener elements 21 made of metal being attached in a row along the tape inner side edge portion 11*b* opposite to right and left fastener tapes 11, a first stop 6 (also called a top stop) disposed on a front end portion of each of the fastener stringers 10 and adjacent to the element row 20, a second stop 7 (also called a bottom stop) disposed so as to extend over a rear end portion of a pair of fastener stringers 10 and adjacent to the element row 20, and a slider 30 disposed slidably along the element row 20.

The slide fastener 1 according to the first embodiment is mainly characterized by the fastener tape 11, and as for a fastener element 21, the first stop 6, the second stop 7, and an slider 30, the same as conventional ones are used (especially, as for the first stop, the second stop, and the slider, the ones for the fastener element made of metal).

Specifically, the fastener element 21 made of metal of the first embodiment includes a coupling head 22 and a pair of leg portions 24 branched and extended from the coupling head 22 via a crotch portion 23. Further, a coupling convex portion is projected on a front surface side (forward side surface side of the tape longitudinal direction) of the coupling head 22, and a coupling recess portion, into which the coupling convex portion, an engaging counterpart, is fitted, is recessed on a rear surface side (backward side surface side of the tape longitudinal direction) of the coupling head 22.

The fastener element 21 is attached to the fastener tape 11 at a predetermined interval by caulking both leg portions 24 in an adjacent direction (inside) with each other and sandwiching the fastener tape in a state where the tape inner side edge portion 11*b* (also called an element attaching portion) including a core thread portion 11*c* described below of the fastener tape 11 is inserted between a pair of leg portions 24. In this case, an end portion of a tape width direction at the leg portions 24 of the fastener element 21 (an end portion of inward side of the tape opposite to the coupling head 22) is located on an inner single-woven region 14 described below.

The slider 30 of the first embodiment is the slider for a fastener element made of metal and is equipped with a slider body 31 and a pull tab 32 that is rotably held on the slider body 31. The slider body 31 has an upper blade 33, a lower blade 34, a guide post 35 connecting between shoulder-side end portions of the upper blade 33 and the lower blade 34, and a pull tab attaching post 36 which is erected on the upper surface side of the upper blade 33.

The upper blade 33 is equipped with an upper blade body 33*a* and right and left upper flange portions 33*b* vertically provided from right and left side edge portions of the upper blade body 33*a* toward the lower blade 34. The lower blade 34 is equipped with a lower blade body 34*a* and right and left lower flange portions 34*b* erected from right and left side edge portions of the lower blade body 34*a* toward the upper blade 33. Further, a tape insertion gap 37 allowing right and left fastener tapes 11 to be inserted into is formed between the upper flange portion 33*b* of the upper blade 33 and the lower flange portion 34*b* of the lower blade 34.

In addition, right and left shoulders sandwiching the guide post 35 are formed at the front end of the slider body 31 and a back opening is formed at the back end of the slider body 31. Also, a substantially Y-shaped element guide passage communicating right and left shoulders and the back opening is formed between the upper blade 33 and the lower blade 34.

The fastener tape 11 of the first embodiment is woven by weft-inserting of the weft yarns 8 as reciprocation of a carrier bar in an opening of warp yarns 9 using weft yarns 8 composed of two-folded yarns and a plurality of warp yarns 9. Incidentally, in the invention, material and fineness of the warp yarns 9 and the weft yarns 8 composing of the fastener tape 11 are not particularly limited, the same yarns as generally-used warp yarns and weft yarns for a conventional slide fastener 1 can be used. Further, the material and the fineness of the warp yarns 9 and the weft yarns 8 can be arbitrarily changed as needed.

The fastener tape 11, as shown in FIG. 3, has a tape main body portion 11*a* sewn to fastener adhered products such as the bag 5 and a tape inner side edge portion (element attaching portion) 11*b* that the fastener elements 21 are attached. The core thread portion 11*c*, into which an expanded core thread 12 is woven, is arranged at the side end edge inside of the fastener tape 11. The core thread portion 11*c*, as described below, is composed by holding and stabilizing the core thread 12 within the hollow weave structure formed at the side end edge of the fastener tape 11.

Figure 5:
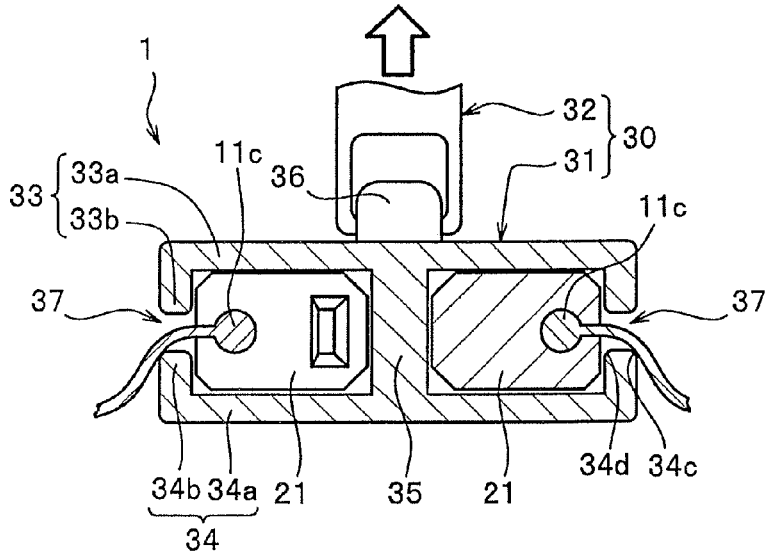
FIG. 5 is a cross sectional view showing the slide fastener when a pull tab is pulled and a slider is slid.

Further, the fastener tape 11, for example in a case where the pull tab 32 of the slider 30 is pulled and the slider 30 is slid, as shown in FIG. 5, makes contact with an outside ridge line portion 34*c* which is arranged by being sandwiched between the upper end surface (an opposed upper surface opposite to the upper flange 33*b* of the upper blade 33) and the outer side surface (a surface which extend in the upward and downward direction of the fastener tape and is perpendicular to the upper end surface of the lower flange portion 34*b*) of the lower flange portion 34*b* in the slider 30. The state, with which the fastener tape 11 and the lower flange portion 34*b* of the slider 30 is in contact, is maintained while the slider 30 is operated by holding the pull tab 32.

In a sliding operation as shown in FIG. 5, when sliding the slider 30 so as to make the fastener element 21 of a pair of right and left fastener stringers 10 engage, the ridge line portion 34*c* of the lower flange portion 34*b*, particularly, the part of shoulder side at the ridge line portion 34*c* makes contact with the fastener tape 11. Further, there is a case where the ridge line portion 34*c* is continuously formed from the outer side surface to the inner side surface of the lower flange portion 34*b* at the shoulder side of the lower flange portion 34*b*. In this case, the ridge line portion 34*c* presents a part of an inside ridge line portion 34*d* arranged between the inner side surface and the upper end surface of the lower flange portion 34*b* described below. The outside ridge line portion 34*c* shall include a surface part which continues from the outer side surface to the inner side surface of the lower flange portion 34*b* like the part of the shoulder side.

In this case, in the fastener tape 11, when sliding the slider 30, the tape part which makes or may make contact with the outside ridge line portion 34*c* of the lower flange portion 34*b* is specified as a slier contact part. The slider contact part continuously exists along the tape longitudinal direction of the fastener tape 11 over the predetermined region in the tape width direction so as to correspond with a position of the outside ridge line portion 34*c* of the slider 30.

The above-mentioned slider contact part is an area where makes or may make contact with the outside ridge line portion 34*c* of the lower flange portion 34*b* by pulling the slider 30 upward of the fastener tape 11 or by pulling the fastener tape 11 toward the lower flange portion 34*b*.

Further, as for the slider contact part, for example, since a dimension between the inner side surface and the outer side surface of the lower flange portion 34*b* of the slider 30 is measured and a position away at a distance of its dimension from the leg portions 24 of the fastener element 21 can be approximated as the slider contact part, it is also possible to identify the above-mentioned approximated position as the slider contact part which is the tape portion corresponding to the position of the outside ridge line portion 34*c* of the lower flange portion 34*b*. Namely, it is included that a case where the slider contact part of the fastener tape 11 is likely to make contact with the outside ridge line portion 34*c* of the lower flange portion 34*b*, for example, when the slider 30 is pulled strongly, even if the slider contact part of the fastener tape 11 does not make contact with the outside ridge line portion 34*c* of the lower flange portion 34*b* under normal use. That is to say, an area of the fastener tape 11 corresponding to the position of the outside ridge line portion 34*c* is an area intersecting with the surface of the fastener tape 11 when drawing a virtual line in the upward and downward direction which passes through the outside ridge line portion 34*c*.

Further, as shown in FIG. 3, the fastener tape 11 of the first embodiment is woven with a single-woven structure and has a weave structure in which a predetermined region in the tape width direction is woven with a double-woven structure.

Specifically explained, the fastener tape 11 of the first embodiment has a double-woven region 13 arranged throughout a predetermined region in the tape width direction including the above-mentioned slider contact part, an inner single-woven region 14 arranged adjacent to the tape inner edge side of the double-woven region 13, a core thread holding region 16 arranged at further tape inner edge side of the inner single-woven region 14 and woven with the hollow weave structure so as to hold the core thread 12, an outer single-woven region 15 arranged adjacent to the tape outer edge side of the double-woven region 13, and an ear portion (not shown) which is formed by hanging a next located weft yarn 8 sequentially and connecting a folded end of a loop at the outer side edge portion of the fastener tape 11.

Incidentally, the tape inner edge side of the fastener tape 11 can be expressed as a central side in the tape width direction of a pair of fastener stringers 10 in a state that a pair of fastener stringers 10 are arranged in a parallel fashion. The tape outer edge side can be expressed as the edge side opposite to the edge where the fastener element of the fastener stringer 10 is attached.

Figure 6:
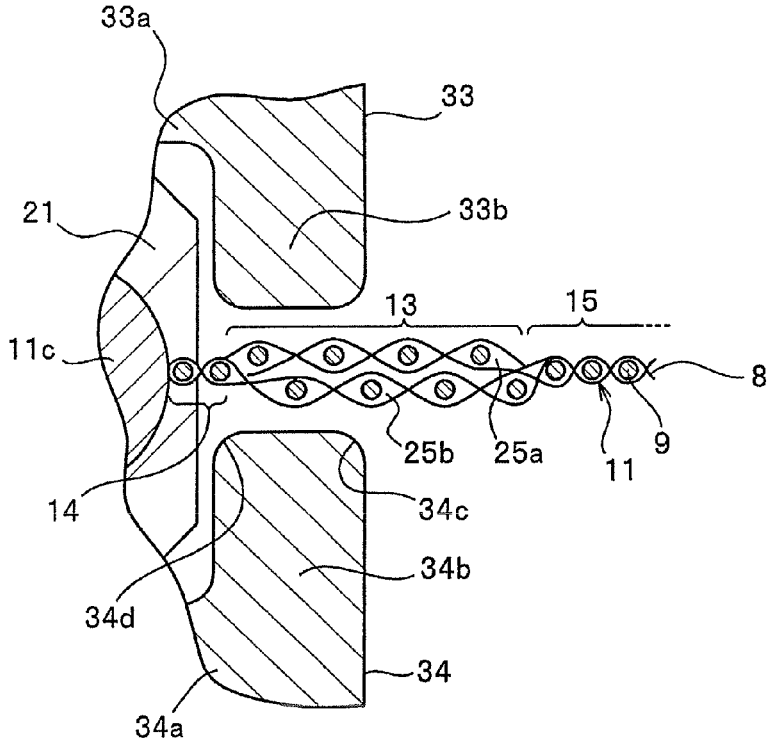
FIG. 6 is a principal portion sectional view expanding and showing a principal portion of the slide fastener.

In the first embodiment, the double-woven region 13 including the slider contact part is configured with the hollow weave structure using weft yarns 8 composed of two-folded yarns and eight warp yarns 9, and as shown in FIG. 6 and the like, is equipped with a first weave portion 25*a* disposed on the upper surface side of the tape and a second weave portion 25*b* disposed on the lower surface side of the tape. In this case, the first weave portion 25*a* and the second weave portion 25*b* are formed by separating from each other, and are connected together at the end portion on the side of the double-woven region 13 in the inner single-woven region 14 and at the end portion on the side of the double-woven region 13 in the outer single-woven region 15.

Further, the double-woven region 13 is composed of a 1/3, 3/1 structure in which four warp yarns 9*a* arranged at the first weave portion 25*a* run on the lower side of a set of weft yarns 8 and the upper side of three sets of weft yarns 8, and four warp yarns 9*b* arranged at the second weave portion 25*b* run on the lower side of three sets of weft yarns 8 and the upper side of a set of weft yarns 8. Furthermore, in the invention, the double-woven region 13, for example, can also be composed of a 1/4, 4/1 structure.

Since the weft yarns 8 which run in the tape width direction are arranged by alternately dividing into the first weave portion 25*a* and the second weave portion 25*b* in the double-woven region 13 composed in this manner, a density of the weft yarns 8 arranged to the first weave portion 25*a* and the second weave portion 25*b* respectively becomes about half the size of the density of the weft yarns 8 in the inner single-woven region 14 and the outer single-woven region 15.

Therefore, in the double-woven region 13 composed of the 1/3, 3/1 structure of the first embodiment, for example, compared to the conventional case where the region is composed of the single-woven structure, the proportion (or the area) of the weft yarns 8 exposed to the upper surface side of the first weave portion 25*a* and the lower surface side of the second weave portion 25*b* is drastically reduced and the proportion (or the area) of the warp yarns 9 exposed to the upper surface side of the first weave portion 25*a* and the lower surface side of the second weave portion 25*b* is increased.

In addition, in the double-woven region 13, since the warp yarns 9 and the weft yarns 8 are arranged by dividing into the first weave portion 25*a* on the upper surface side and the second weave portion 25*b* on the lower surface side, the flexibility is increased and the tape thickness becomes thick compared to the inner single-woven region 14 and the outer single-woven region 15 of the fastener tape 11.

The inner single-woven region 14 of the first embodiment is formed by weft yarns 8 composed of two-folded yarns and two warp yarns 9 and is composed of a plain weave structure (1/1 structure) in which a single warp yarn 9 alternately runs on the upper side of a set of weft yarns 8 and on the lower side of a set of weft yarns 8. As a result, the inner single-woven region 14 has a solid structure, makes the tape thickness in the inner single-woven region 14 thin, and can smoothen the front surface and back surface of the tape in the inner single-woven region 14.

Further, the outer single-woven region 15 is formed between the double-woven region 13 and the ear portion using the weft yarns 8 composed of two-folded yarns and a plurality of warp yarns 9, and is composed of a twill weave structure (2/2 structure) in which a single warp yarn 9 alternately runs on the upper side of two sets of weft yarns 8 and on the lower side of two sets of weft yarns 8.

With the above-mentioned arrangement of the inner single-woven region 14 and outer single-woven region 15 adjacent to the double-woven region 13 so as to sandwich the double-woven region 13, it allows to stabilize a weave structure of the double-woven structure 13 and to prevent a position of the warp yarns 9 arranged in the double-woven region 13 from causing a shift in the weft direction. Further, the inner single-woven region 14 stabilizes a weave structure of the core thread holding region 16 and serves a role to stabilize a position of the core thread 12 held at the core thread holding region 16.

A boundary between the inner single-woven region 14 and the double-woven region 13 is located between a warp yarn 9 on the side of the double-woven region 13 out of two warp yarns 9 arranged in the inner single-woven region 14 (warp yarns which are in contact with all weft yarns) and a warp yarn 9 of the double-woven region 13 adjacent to the above warp yarn 9 (a warp yarn which is in contact with only a weft yarn which forms either of the first weave portion 25*a* or the second weave portion 25*b*). In other words, the extent of the inner single-woven region 14 is from a warp yarn 9 adjacent to the core thread portion 11*c* to a warp yarn 9 adjacent to the double-woven region 13 of the inner single-woven region 14.

Further, a boundary between the outer single-woven region 15 and the double-woven region 13 is located between a warp yarn 9 on the side closest to the double-woven region 13 out of warp yarns 9 (warp yarns which are in contact with all weft yarns) arranged in the outer single-woven region 15 and a warp yarn 9 of the double-woven region 13 adjacent to the above warp yarn 9 (warp yarn which is in contact with only a weft yarn which forms either of the first weave portion 25*a* or the second weave portion 25*b*). In other words, the extent of the outer single-woven region 15 is from a warp yarn 9 adjacent to the double-woven region 13 of the outer single-woven region 15 to a warp yarn 9 adjacent to the ear portion.

The core thread holding region 16 of the first embodiment is the similar hollow weave structure to the double-woven region 13, in other words, it is composed of the 1/3, 3/1 structure and the core thread 12 is held between a weave portion disposed on the upper surface side of the tape and a weave portion disposed on the lower surface side of the tape.

Further, in the fastener tape 11 of the first embodiment, the inner single-woven region 14 whose tape thickness is thin is arranged corresponding to the position of the inside ridge line portion 34*d* arranged between the upper end surface and the inner side surface at the lower flange portion 34*b* of the slider 30, and the boundary between the inner single-woven region 14 and the double-woven region 13 is formed between a position of the inner side surface at the lower flange portion 34*b* and a position of the outsider ridge line portion 34*c* (See FIGS. 4 and 6). In the slide fastener 1 of the first embodiment, the fastener tape 11 is located in a substantially center portion of the tape front and back direction with respect to the fastener element 21 and is inserted into a tape insertion gap 37 of the slider 30.

In this case, since the inner single-woven region 14 of the fastener tape 11 is arranged adjacent to the core thread portion 11*c* held by the fastener element 21, the inner single-woven region 14 is located in a substantially center portion of the tape front and back direction at the tape insertion gap 37 of the slider 30 from a positional relationship between the fastener element 21 and the slider 30, and is scarcely contact with the lower flange portion 34*b* or the upper flange portion 33*b* of the slider 30.

However, for example, with a long-term usage of the slide fastener 1, a repeated sliding operation of the slider 30 causes a repeated collision between the lower flange portion 34*b* and the fastener element 21. Therefore, the inside ridge line portion 34*d* at the lower flange portion 34*b* can be gradually plastically deformed so as to sharpen a tip end portion while extending upward little by little toward the tape insertion gap 37. When the inside ridge line portion 34*d* which is sharply deformed in this manner makes contact with the fastener tape 11 while extending upward little by little, a failure that the fastener tape 11 is cut occurs when sliding the slider 30.

With respect to such a failure, in the slide fastener 1 of the first embodiment, the inner single-woven region 14 whose tape thickness is thin as mentioned above is arranged corresponding to the position of the inside ridge line portion 34*d* at the lower flange portion 34*b* of the slider 30. This makes the deformed inside ridge line portion 34*d* difficult to contact with the fastener tape 11 even if the inside ridge line portion 34*d* at the lower flange portion 34*b* is deformed so as to extend upward as mentioned above, which enables to extend the life of the slide fastener 1 by significantly delaying the time when the fastener tape 11 is cut by the inside ridge line portion 34*d* of the slider 30.

In the slide fastener 1 of the first embodiment having above configuration, for example, when the slider 30 is not operated, right and left fastener tapes 11, as mentioned above, are held at the substantially center portion of the tape insertion gap 37 of the slider 30 and are in a state of not contacting with either the lower flange portion 34*b* or the upper flange portion 33*b* of the slider 30 (See FIGS. 4 and 6).

Figure 7:
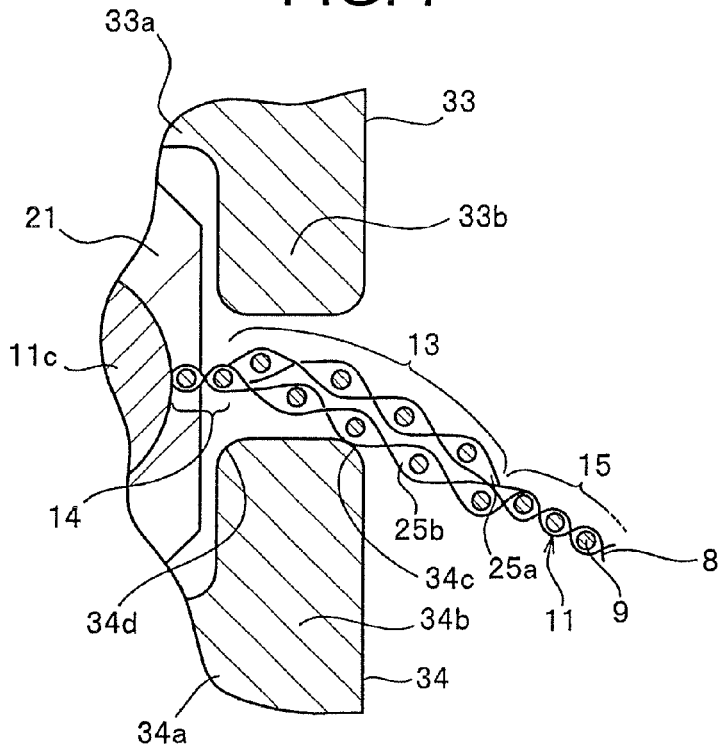
FIG. 7 is a principal portion sectional view expanding and showing a principal portion of the slide fastener when the pull tab is pulled and the slider is slid.

Meanwhile, for example in a case where the pull tab 32 is pulled and the slider 30 is slid, as shown in FIGS. 5 and 7, the slider 30 receives a tensile force from the pull tab 32 and is slid while being pulled obliquely upward. At this time, since the fastener tape 11 is curved so as to be inclined downward in the tape width direction from the tape inner side edge portion 11*b* toward the tape outer side edge portion, the slider 30 is slid along the element row 20 in a state where the outside ridge line portion 34*c*, which is arranged between the upper end surface and the outer side surface of the lower flange portion 34*b*, contacts with the double-woven region 13 of the fastener tape 11. Further, in a case where the slider 30 of the slide fastener 1 attached to a bag is slid, it becomes more prominent that the slider 30 is slid while being pulled obliquely upward because a sliding operation is carried out in a state where the bag is being put on a shoulder.

In this case, in the fastener tape 11 of the first embodiment, as mentioned above, an area of the weft yarns 8 exposed to the lower surface side of the second weave portion 25*b* of the double-woven region 13 is drastically reduced and an area of the warp yarns 9 exposed to the lower surface side of the second weave portion 25*b* is increased. Therefore, the weft yarns 8 themselves are less likely to directly contact with the lower flange portion 34*b* of the slider 30, and the slider 30 mainly makes contact with the warp yarns 9 exposed to the lower surface side of the second weave portion 25*b*, which allows to minimize the extent of damage of weft yarns 8 received from the slider 30. Accordingly, even if the double-woven region 13 of the fastener tape 11 directly makes contact with the lower flange portion 34*b* of the slider 30 when sliding the slider 30, the weft yarns 8 arranged in the double-woven region 13 are less likely to be cut.

In addition, in a case where the fastener tape 11 is curved so as to be inclined downward from the tape inner side edge portion 11*b* toward the tape outer side edge portion as mentioned above when sliding the slider 30, in the double-woven region 13, the first weave portion 25*a* arranged at the upper surface side of the tape is elongated and supports a curvature of the fastener tape 11, and the second weave portion 25*b* arranged at the lower surface side of the tape is kept in a state of slightly loosening in the tape width direction by only the part arranged more inside circular arc than the first weave portion 25*a*.

At this time, at the second weave portion 25*b* which makes contact with the lower flange portion 34*b* of the slider 30, the degree of freedom capable of moving in the tape width direction is larger than the first weave portion 25*a*. Therefore, even if the second weave portion 25*b* makes contact with the lower flange portion 34*b* of the slider 30 and is subjected to stress, it is possible to disperse the stress effectively throughout the second weave portion 25*b* without focusing the stress only on a few warp yarns 9. This allows to effectively prevent a position of each warp yarn 9 from causing a shift in the tape width direction on the second weave portion 25*b* and to prevent an occurrence of shift of warp yarns 9 on the second weave portion 25*b*.

Accordingly, in the slide fastener 1 of the first embodiment, even if the slider 30 is repeatedly slid, it allows to extremely reduce the possibility that the weft yarns 8 are cut by a contact of the slider 30 and to further extend the life of the slide fastener 1 because the weft yarns 8 are not exposed to the second weave portion 25*b* of the double-woven region 13 for a long time due to a shift of warp yarns 9.

In addition, in the double-woven region 13 of the fastener tape 11 of the first embodiment, as mentioned above, flexibility is increased and the tape thickness becomes thick compared to the inner single-woven region 14 and the outer single-woven region 15. Due to high flexibility of the double-woven region 13, it allows a small movement of each fastener element 21 when engaging and disengaging the element row 20 by sliding the slider 30 and enables to cause the fastener tape 11 to be easily curved along an element guide passage. As a result, slidability and operability of the slider 30 are significantly improved, and it is possible to carry out a sliding operation of the slider 30 smoothly with a light force.

Further, since the double-woven region 13 which passes through the tape insertion gap 37 of the slider 30 is formed thick, a space part of the tape insertion gap 37 is filled widely by the double-woven region 13. Therefore, when sliding the slider 30, it is possible to effectively prevent other members such as fabric other than the slide fastener 1 from being caught in the tape insertion gap 37 of the slider 30 and to carry out a sliding operation of the slider 30 more smoothly and stably.

Figure 8:
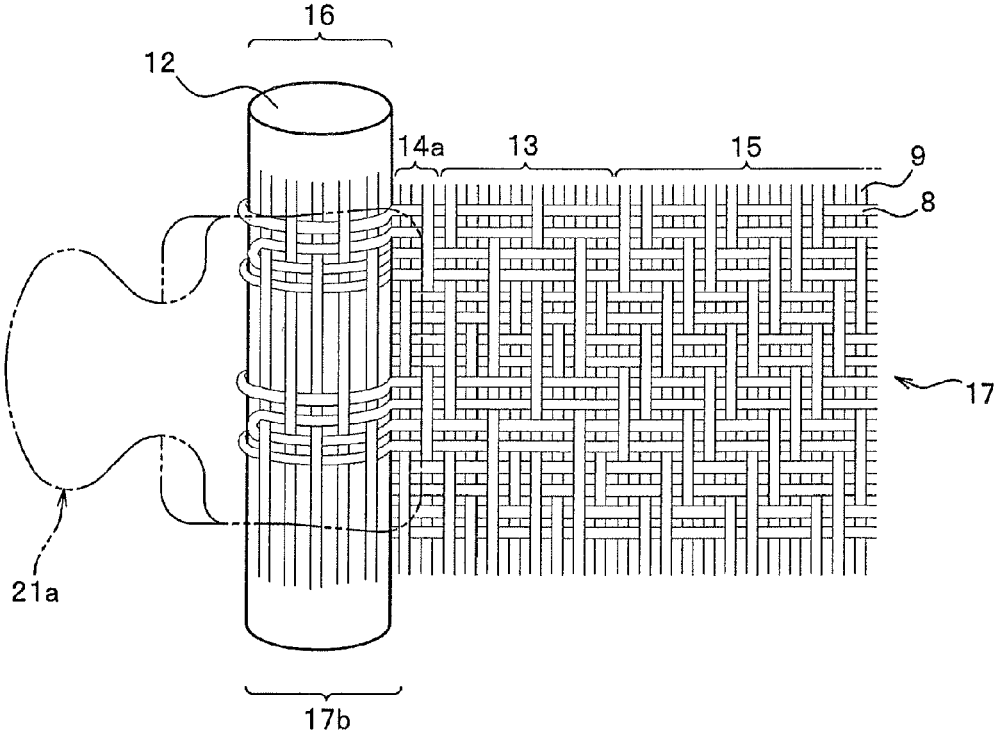
FIG. 8 is a structure diagram schematically showing a weave structure of the fastener tape in the slide fastener according to a modification of the first embodiment.

Furthermore, in the invention, material and modes of the fastener element can be changed arbitrarily as mentioned above. For example, as shown in FIG. 8, it is possible to attach a fastener element 21*a* to a tape inner side edge portion 17*b* of a fastener tape 17. In this case, the fastener element 21*a* is formed by an injection molding of synthetic resin and has a body portion fixed to the fastener tape 17, a neck portion extending outward from the body portion and having a constricted form so that the dimension of the tape longitudinal direction makes narrow, and a coupling head which further extend outward from the neck portion. In this case, the end portion in the tape width direction of the body portion of the fastener element 21*a* (end portion of the tape inner side opposite to the coupling head) is located on an inner single-woven region 14*a* described below.

In addition, in the invention, if the inner single-woven region and the outer single-woven region of the fastener tape are respectively formed with a single-woven structure, the specific weave structure is not particularly limited. For example, as shown in FIG. 8, it is possible to configure the fastener tape 17 by changing the weave structure of the inner single-woven region 14*a* from the plain weave structure (1/1 structure) to the twill weave structure (2/2 structure) in which a single warp yarn 9 alternately runs on the upper side of two sets of weft yarns 8 and on the lower side of two sets of weft yarns 8.

By configuring the inner single-woven region 14*a* with the 2/2 structure in this manner, flexibility of the inner single-woven region 14*a* is increased. Therefore, it is possible to further improve the slidability and operability of the slider 30. In addition, in a case where the inner single-woven region 14*a* is the 2/2 structure, the tape thickness of the inner single-woven region 14*a* is thicker than the case of the 1/1 structure.

By making the thickness of the inner single-woven region 14*a* of the fastener tape 17 thick, in a case where the fastener element 21*a* is formed by an injection molding of synthetic resin as mentioned above, it is possible to perform injection molding in a state where the fastener tape 17 is stably sandwiched between molding dies. Therefore, it is possible to stably form the fastener element 21*a* at a predetermined position of the fastener tape 17, and to prevent an occurrence of molten metal leakage during injection molding more effectively.

Figure 9:
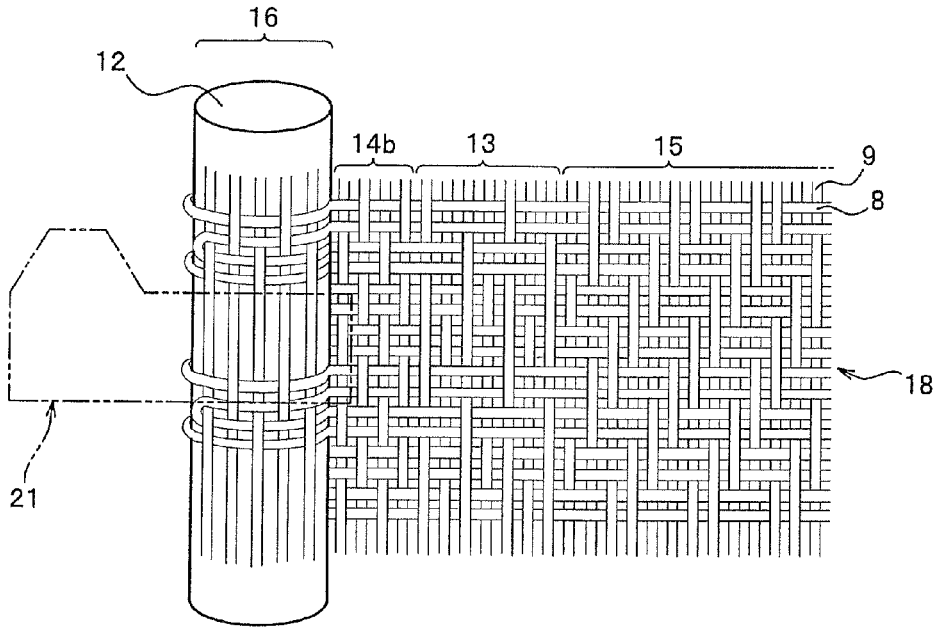
FIG. 9 is a structure diagram schematically showing a weave structure of the fastener tape in the slide fastener according to another modification of the first embodiment.
Figure 10:
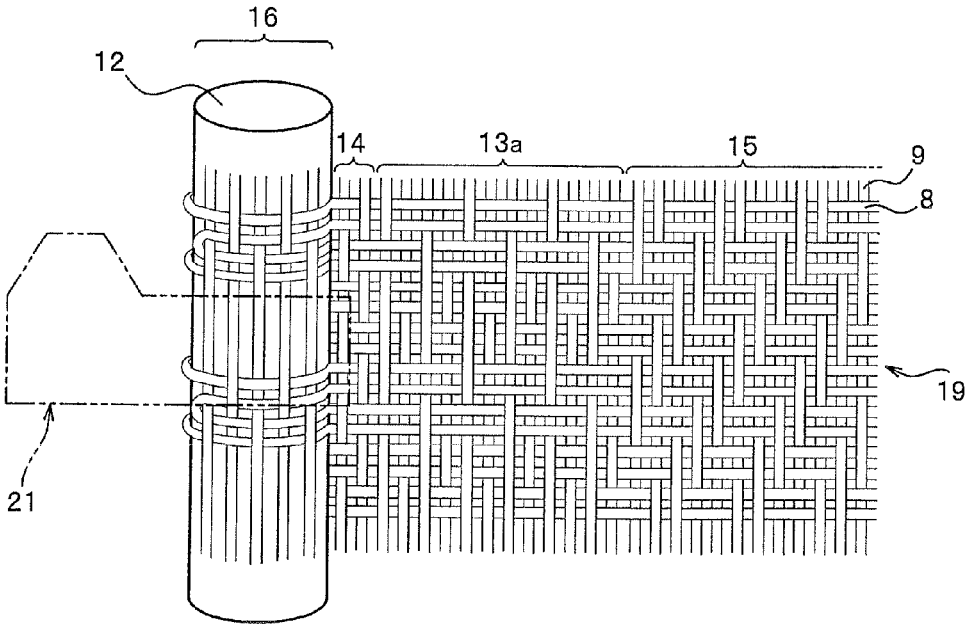
FIG. 10 is a structure diagram schematically showing a weave structure of the fastener tape in the slide fastener according to further another modification of the first embodiment.

Further, in the invention, depending on the intended use of the slide fastener 1, it is possible to arbitrarily change the number of warp yarns 9 arranged to each region of the fastener tape. For example, as shown in FIG. 9, it enables to increase the number of warp yarns 9 arranged in the inner single-woven region 14*b* of the fastener tape 18 to four, and then as shown in FIG. 10, it enables to set the number of warp yarns 9 arranged in a double-woven region 13*a* of a fastener tape 19 to 12.

In this case, it is preferable that the number of warp yarns 9 arranged in the double-woven region 13 and 13*a* of the invention is set especially to eight or more but not exceeding 12 yarns. Setting eight or more warp yarns 9 to be arranged in the double-woven region 13 and 13*a* enables to reliably configure a predetermined area including the slider contact part of the fastener tape 11 with the double-woven structure. Further, setting warp yarns 9 arranged in the double-woven region 13 and 13*a* not more than 12 can prevent a width dimension of the double-woven region 13 and 13*a* from becoming too large, and prevent the fastener tape 11, 17, and 18 from being deformed by the first weave portion 25*a* and the second weave portion 25*b* being separated.

Second Embodiment

Figure 11:
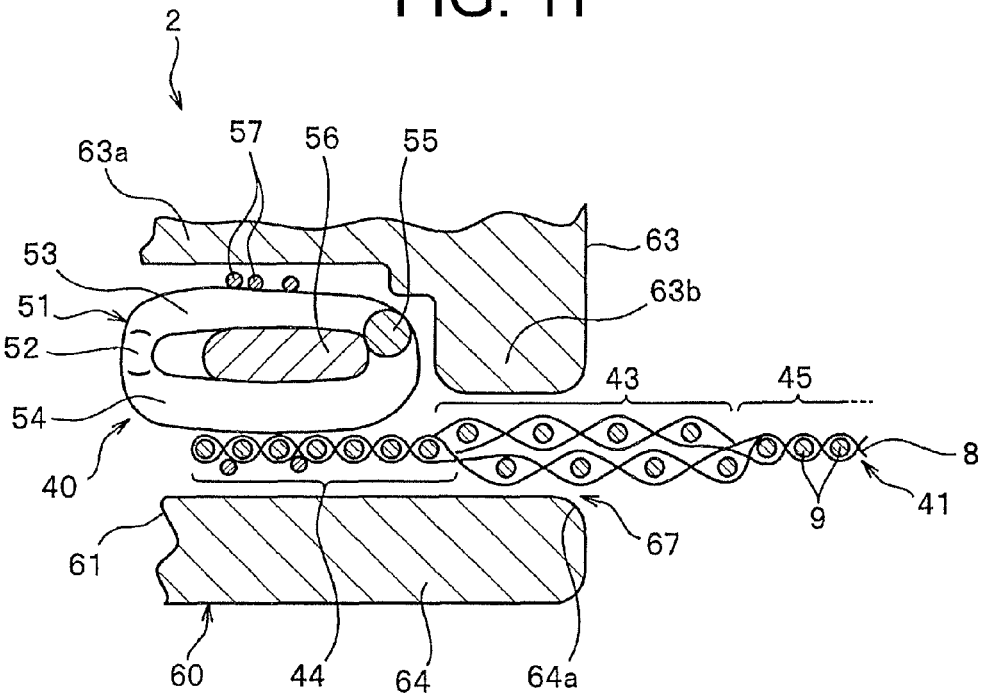
FIG. 11 is a principal portion sectional view expanding and showing a principal portion of the slide fastener according to a second embodiment of the invention.

FIG. 11 is a principal portion sectional view expanding and showing a principal portion of the slide fastener according to the second embodiment of the invention.

The slide fastener 2 according to the second embodiment is configured as a normal-type of slide fastener, and has a pair of fastener stringers 40 in which a coil-shaped fastener element 51 is sewn along the inner side edge portion opposite to right and left fastener tapes 41, a first stop (not shown)and a second stop (not shown) disposed on a front end portion and on a rear end portion of each of the fastener stringers 40, and a slider 60 disposed slidably along a continuous element row of the fastener stringer 40.

In the slide fastener 2 of the second embodiment, the fastener element 51 has a similar configuration to a conventional coil-shaped fastener element, and the first stop, the second stop, and the slider 60 have a similar configuration to the conventional first stop, second stop and slider used for the coil-shaped fastener element.

Specifically, the coil-shaped fastener element 51 of the second embodiment has a coupling head 52, an upper leg portion 53 and a lower leg portion 54 disposed so as to extend in the tape width direction from the coupling head 52, and a connection portion 55 which connects between the upper leg portion 53 of the fastener element 51 and the lower leg portion 54 of the adjacent next located fastener element 51. The fastener element 51 forms the continuous element row by being sewn to the fastener tape 41 with double chain stitching using a sewing yarn 57 in a state where a core thread 56 is inserted between the upper leg portion 53 and the lower leg portion 54.

The slider 60 of the second embodiment is a slider for the coil-shaped fastener element 51, and is equipped with a slider body 61 and a pull tab (not shown) that is rotably held on the slider body 61. The slider body 61 has an upper blade 63, a lower blade 64, a guide post (not shown) connecting between shoulder-side end portions of the upper blade 63 and the lower blade 64, and a pull tab attaching post (not shown) which is erected on the upper surface side of the upper blade 63.

The upper blade 63 is equipped with an upper blade body 63*a* and right and left upper flange portions 63*b* vertically provided from right and left side edge portions of the upper blade body 63*a* toward the lower blade 64. Further, the lower blade 64 is formed flat and the lower flange portion is not provided at right and left side edge portions of the lower blade 64. In this case, a tape insertion gap 67 which inserts the fastener tape 41 is formed between the upper flange portion 63*b* of the upper blade 63 and right and left side edge portions of the lower blade 64.

The fastener tape 41 of the second embodiment is woven using weft yarns 8 composed of two-folded yarns and a plurality of warp yarns 9, and has a tape main body portion and a tape inner side edge portion (element attaching portion) that the fastener element 51 is attached. Further, in the fastener tape 41, in a case where a pull tab of the slider 60 is pulled and the slider 60 is slid, a slider contact part, which makes contact with a ridge line portion 64*a* arranged by being sandwiched between an upper surface (an opposed upper surface opposite to the upper blade 63) and an outer side surface (a surface which extends in the upward and downward direction of the fastener tape and is perpendicular to the upper surface of the lower blade 64) of the lower blade 64 of the slider 60, exists continuously along the tape longitudinal direction.

Further, the fastener tape 41 of the second embodiment has a double-woven region 43 arranged throughout a predetermined region in the tape width direction including the slider contact part, an inner single-woven region 44 arranged adjacent to the tape inner edge side of the double-woven region 43, an outer single-woven region 45 arranged adjacent to the tape outer edge side of the double-woven region 43, and an ear portion (not shown) which is formed by hanging a next located weft yarn 8 sequentially and connecting a folded end of a loop at an outer side edge portion of the fastener tape 41. In this case, the fastener element 51 is located on the inner single-woven region 44.

Further, each weave structure of the double-woven region 43, the inner single-woven region 44, and the outer single-woven region 45 in the second embodiment is configured in the same way as the double-woven region 13, the inner single-woven region 14, and the outer single-woven region 15 of the fastener tape 11 in the above-mentioned first embodiment.

In the slide fastener 2 of the second embodiment as mentioned above, for example when a pull tab is pulled and the slider 60 is slid, weft yarns 8 arranged in the double-woven region 43 are less likely to be cut as is the case in the slide fastener 1 of the above-mentioned first embodiment even though the double-woven region 43 of the fastener tape 41 makes contact with the ridge line portion 64*a* on the side of the lower blade 64 of the slider 60. Further, even if the slider 60 is repeatedly slid, it is possible to prevent an occurrence of a shift of warp yarns 9 at the second weave portion 25*b* in the double-woven region 43, to extremely reduce the possibility that weft yarns 8 are cut, and to further extend the life of the slide fastener 2.

Further, even in the slide fastener 2 of the second embodiment, since the double-woven region 43 is arranged in a predetermined region of the fastener tape 41, flexibility in the double-woven region 43 is increased and the tape thickness becomes thick. Therefore, the effect that slidability and operability of the slider 60 are improved can be obtained and it is possible to effectively prevent other members from being caught in the tape insertion gap 67 of the slider 60.

Further, in the slider 60 of the second embodiment, right and left lower flange portions erected from right and left side edge portions of the lower blade 64 toward the upper blade 63 may be equipped. In this case, the lower flange portion is smaller than the dimension in the upward and downward direction of the upper flange portion 63*b*. Then, the tape insertion gap that inserts right and left fastener tapes 11 is formed between the upper flange portion 63*b* of the upper blade 63 and the lower flange portion of the lower blade 64. In the slider, the ridge line portion is arranged between the upper end surface (an opposed upper surface) opposite to the upper blade 63 of the lower flange portion and the outer side surface of the lower flange portion (a surface which extends in the upward and downward direction of the fastener tape and is perpendicular to the upper end surface of the lower flange portion).

Third Embodiment

Figure 12:
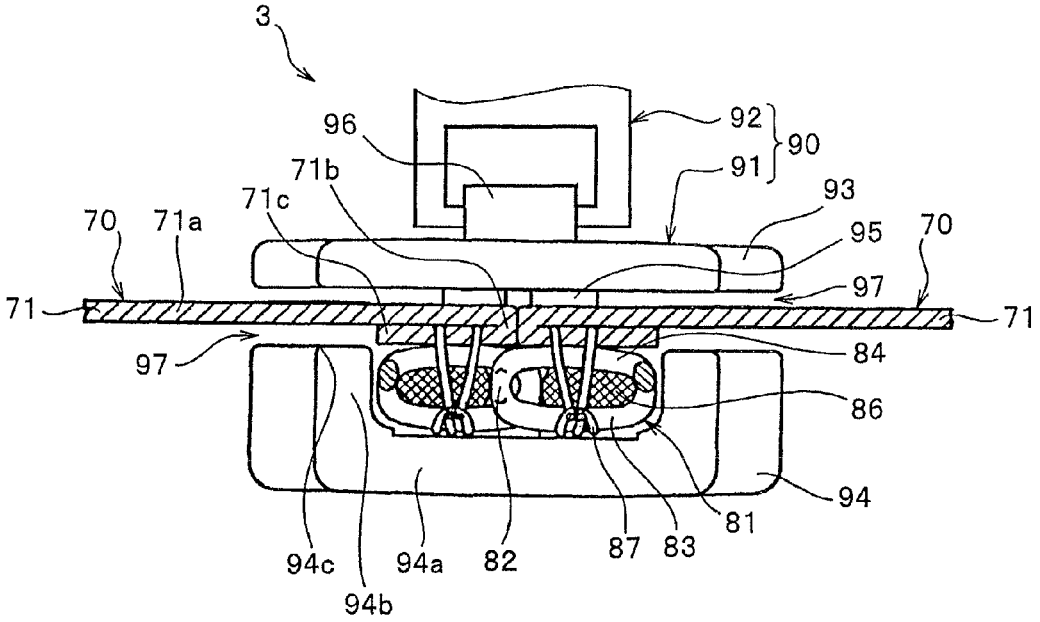
FIG. 12 is a sectional view showing a concealed type slide fastener according to a third embodiment of the invention.
Figure 13:
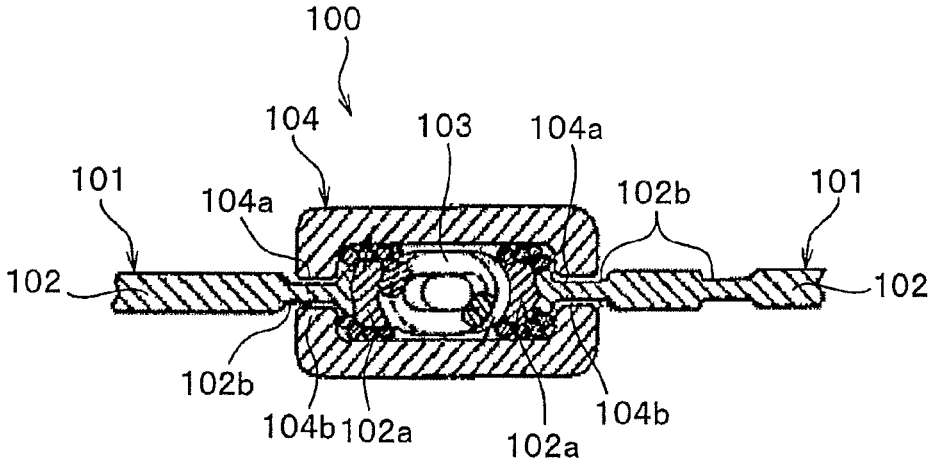
FIG. 13 is a sectional view showing a conventional slide fastener.

FIG. 12 is a sectional view showing a concealed type slide fastener according to the third embodiment of the invention.

The concealed type slide fastener 3 according to the third embodiment has a pair of concealed type fastener stringers 70, a first stop (not shown) and a second stop (not shown) disposed on a front end portion and on a rear end portion of each of the fastener stringers 70, and a slider 90 arranged slidably along a continuous element row of the fastener stringer 70.

The concealed type fastener stringer 70 of the third embodiment has a fastener tape 71 and a continuous element row arranged along an element attaching portion 71*c* of the fastener tape 71. The fastener tape 71 is equipped with a tape main body portion 71*a*, a folded tape portion 71*b* which is extended from one side edge of the tape main body portion 71*a* and which is folded into the U-shape, and an element attaching portion 71*c* which is further extended from the folded tape portion 71*b*.

The continuous element row is configured by being sewn to the fastener tape 71 with double chain stitching using a sewing yarn 87 in a state where a coil-shaped fastener element 81 inserts through a core thread 86 between an upper leg portion 83 and a lower leg portion 84. Each of the fastener element 81 is attached to the element attaching portion 71*c* so as to project a coupling head 82 outward from the folded tape portion 71*b* of the fastener tape 71. In this case, the fastener tape 71 is configured in a way that the folded tape portions 71*b* of right and left fastener tapes 71 contact with each other when engaging right and left continuous element rows.

The slider 90 of the third embodiment is a slider for the concealed type slide fastener, and is equipped with a slider body 91 and a pull tab 92 that is rotably held on the slider body 91. The slider body 91 has an upper blade 93, a lower blade 94, a guide post 95 which connects between shoulder-side end portions of the upper blade 93 and the lower blade 94, and a pull tab attaching post 96 which is erected on the upper surface of the upper blade 93.

The upper blade 93 is formed flat and the upper flange portion is not provided at right and left side edge portions of the upper blade 93. Further, the lower blade 94 is equipped with a lower blade body 94*a* and right and left lower flange portions 94*b* which are erected from right and left edges of the lower blade body 94*a* toward the upper blade 93. In this case, a tape insertion gap 97 which inserts the fastener tape 71 is formed between right and left side edge portions of the upper blade 93 and the lower flange portion 94*b* of the lower blade 94.

In the third embodiment, the fastener tape 71 is woven using weft yarns composed of two-folded yarns and a plurality of warp yarns. Further, in the fastener tape 71, in a case where the pull tab 92 of the slider 90 is pulled and the slider 90 is slid, a slider contact part which makes contact with the upper end edge (tip edge) at the lower flange portion 94*b* of the slider 90, in particular, which makes contact with an outside ridge line portion 94*c* between the upper end surface and the outer side surface at the lower flange portion 94*b*, exists continuously along the tape longitudinal direction.

Further, although an illustration is omitted, the fastener tape 71 of the third embodiment has a double-woven region arranged throughout a predetermined region in the tape width direction including the slider contact part, an inner single-woven region arranged adjacent to the tape inner edge side of the double-woven region, an outer single-woven region arranged adjacent to the tape outer edge side of the double-woven region, and an ear portion formed by hanging a next located weft yarn sequentially and connecting a folded end of a loop at an outer side edge portion of the fastener tape 71.

In this case, each weave structure of the double-woven region, the inner single-woven region, and the outer single-woven region of the third embodiment is configured in the same way as the fastener tape 11, 41 of the above-mentioned first and second embodiments. In other words, the double-woven region of the third embodiment is configured with the hollow weave structure of which the number of warp yarns 9 is set to eight or more but not exceeding 12 yarns, and is equipped with the first weave portion arranged on the side of the first surface (tape outer surface) of the tape, a tape surface on the side to which the fastener element is attached, and the second weave portion arranged on the side of the second surface (tape inner surface) of the tape which contacts with the lower flange portion 94*b* of the slider 90.

Further, in the fastener tape 71 of the third embodiment, a boundary between the inner single-woven region and the double-woven region is formed between a position of an inner side surface and an outside position of the ridge line portion 94*c* at the lower flange portion 94*b* of the slider 90. The inner single-woven region whose tape thickness is thin is arranged corresponding to a position of the inside ridge line portion arranged between an upper end surface and the inner side surface at the lower flange portion 94*b* of the slider 90.

In the above-mentioned concealed type slide fastener 3 of the third embodiment, as is the case with the normal-type of slide faster 1, 2 of the first and second embodiments, in the double-woven region, an area of the weft yarns exposed to the side of the tape second surface of the second weave portion is drastically reduced, and an area of the warp yarns exposed to the side of the tape second surface is increased.

Therefore, the weft yarns of the second weave portion at the double-woven region are less likely to directly contact with the outside ridge line portion 94*c* at the lower flange portion 94*b* of the slider 90, and it is possible to minimize the extent of damage of weft yarns received from the slider 90. Accordingly, even if the double-woven region of the fastener tape 71 makes contact with the outside ridge line portion 94*c* at the lower flange portion 94*b* of the slider 90 when sliding the slider 90, the weft yarns arranged in the double-woven region are less likely to be cut.

In addition, in the concealed type slide faster 3, in the double-woven region formed at the folded tape portion 71*b*, the first weave portion arranged on the side of the tape first surface is elongated and supports bent shape of the fastener tape 71, and the second weave portion arranged on the side of tape second surface is kept in a state of slightly loosening in the tape width direction by only the part arranged more inside than the first weave portion.

At this time, at the second weave portion which contacts with the outside ridge line portion 94*c* of the slider 90 at the folded tape portion 71*b*, the degree of freedom capable of moving in the tape width direction is larger than the first weave portion. Therefore, even if the second weave portion makes contact with the outside ridge line portion 94*c* of the slider 90 and is subjected to stress, it is possible to disperse the stress effectively throughout the second weave portion. This allows to effectively prevent a position of each of warp yarns from causing a shift in the tape width direction and to prevent an occurrence of shift of warp yarns on the second weave portion.

Accordingly, in the concealed type slide faster 3 of the third embodiment, even if the slider 90 is repeatedly slid, it allows to extremely reduce the possibility that the weft yarns are cut by a contact of the slider 90 and to further extend the life of the concealed type slide fastener 3 because the weft yarns are not exposed to the double-woven region of the fastener tape 71 for a long time due to a shift of warp yarns.

DESCRIPTION OF REFERENCE NUMERALS

1, 2 Slide fastener
3 Concealed type slide fastener

5 Bag (shoulder bag)
5*a*, 5*b* Opening portion
6 First stop
7 Second stop
8 Weft yarn
9, 9*a*, 9*b* Warp yarn
10 Fastener stringer
11 Fastener tape
11*a* Tape main body portion
11*b* Tape inner side edge portion (element attaching portion)
11*c* Core thread portion
12 Core thread
13, 13*a* Double-woven region
14 Inner single-woven region
14*a*, 14*b* Inner single-woven region
15 Outer single-woven region
16 Core thread holding region
17 Fastener tape
17*b* Tape inner side edge portion
18 Fastener tape
19 Fastener tape
20 Element row
21, 21*a* Fastener element
22 Coupling head
23 Crotch portion
24 Leg portion
25*a* First weave portion
25*b* Second weave portion
30 Slider
31 Slider body
32 Pull tab
33 Upper blade
33*a* Upper blade body
33*b* Upper flange portion
34 Lower blade
34*a* Lower blade body
34*b* Lower flange portion
34*c* Outside ridge line portion
34*d* Inside ridge line portion
35 Guide post
36 Pull tab attaching post
37 Tape insertion gap
40 Fastener stringer
41 Fastener tape
43 Double-woven region
44 Inner single-woven region
45 Outer single-woven region
51 Fastener Element
52 Coupling head
53 Upper leg portion
54 Lower leg portion
55 Connection portion
56 Core thread
57 Sewing yarn
60 Slider
61 Slider body
63 Upper blade
63*a* Upper blade body
63*b* Upper flange portion
64 Lower blade
64*a* Ridge line portion
67 Tape insertion gap
70 Fastener stringer
71 Fastener tape
71*a* Tape main body portion
71*b* Folded tape portion
71*c* Element attaching portion
81 Fastener element
82 Coupling head
83 Upper leg portion
84 Lower leg portion
86 Core thread
87 Sewing yarn
90 Slider
91 Slider body
92 Pull tab
93 Upper blade
94 Lower blade
94*a* Lower blade body
94*b* Lower flange portion
94*c* Ridge line portion
95 Guide post
96 Pull tab attaching post
97 Tape insertion gap

The invention claimed is:

1. A slide fastener comprising:

a pair of fastener stringers each having an element row attached along a respective tape inner side edge portion of a woven fastener tape and a slider capable of engaging and disengaging the element rows; the slider having upper and lower blades, a guide post connecting between the upper and lower blades, lower flange portions erected along each of a right side edge portion and a left side edge portion of the lower blade, and ridge line portions formed on each of the lower flange portions between an upper surface and an outer side surface of the lower flange portion, wherein each of the fastener tapes has an inner single-woven region formed at the tape inner side edge portion and an outer single-woven region formed at a tape outer side edge portion of a double-woven region, the inner single-woven region and the outer single-woven region woven with a single-woven structure, the double-woven region woven with a double-woven structure and formed between the inner single-woven region and the outer single-woven region so the respective ridge line of the slider passes along the double-woven region;

each of the fastener tapes has weft yarns running in a tape width direction in the inner single-woven region, the double-woven region, and the outer single-woven region, each of the double-woven regions includes a first weave portion on a tape upper surface side and a second weave portion on a tape lower surface side, and the weft yarns in the double-woven region are divided into the first weave portion and the second weave portion, and the weft yarns are connected together at an end portion of the inner single-woven region on a side of the double-woven region and at an end portion of the outer single-woven region on a side of the double-woven region respectively.

2. The slide fastener according to claim 1, wherein a boundary between the double-woven region and the inner single-woven region in each of the fastener tapes is arranged between an inner side surface of the lower flange portion of the slider and the-ridge line portion.

3. The slide fastener according to claim 1, wherein the double-woven structure is a hollow weave structure.

4. The slide fastener according to claim 1, wherein a core thread is woven into the tape inner side edge portion of each of the fastener tapes, the element rows each include a plurality of fastener elements attached to the respective tape inner side edge portion, each of the fastener elements includes a pair of leg portions sandwiching the fastener tape or a body portion fixed to the fastener tape, and an end portion of the leg portions or the body portion is located on the inner single-woven region.

5. The slide fastener according to claim 1, wherein each of the fastener tapes includes at least 8 but no more than 12 warp yarns in the double-woven region.

6. The slide fastener according to claim 1, wherein each of the fastener tapes has a core thread portion along the tape inner side edge portion, and the core thread portion has a double-woven structure, is on a side of the inner single-woven region opposite the double-woven region, and holds a core thread.

* * * * *